US009751087B2

(12) United States Patent
Watts et al.

(10) Patent No.: US 9,751,087 B2
(45) Date of Patent: Sep. 5, 2017

(54) COMMINUTION MILL WITH CABLE IMPACT ARMS

(71) Applicants: Gary L. Watts, Raytown, MO (US); Keith H. O'Brien, Lee's Summit, MO (US); Dennis P. O'Brien, Lee's Summit, MO (US)

(72) Inventors: Gary L. Watts, Raytown, MO (US); Keith H. O'Brien, Lee's Summit, MO (US); Dennis P. O'Brien, Lee's Summit, MO (US)

( * ) Notice: Subject to any disclaimer, the term of this patent is extended or adjusted under 35 U.S.C. 154(b) by 559 days.

(21) Appl. No.: 14/495,354

(22) Filed: Sep. 24, 2014

(65) Prior Publication Data

US 2015/0034747 A1 Feb. 5, 2015

Related U.S. Application Data

(63) Continuation-in-part of application No. 13/623,379, filed on Sep. 20, 2012, now Pat. No. 9,498,780.

(60) Provisional application No. 61/881,525, filed on Sep. 24, 2013.

(51) Int. Cl.

| | |
|---|---|
| ***B02C 13/288*** | (2006.01) |
| ***B02C 13/14*** | (2006.01) |
| ***B02C 13/282*** | (2006.01) |
| *B02C 13/28* | (2006.01) |
| *B02C 13/286* | (2006.01) |

(52) U.S. Cl.

CPC ..... *B02C 13/288* (2013.01); *B02C 13/14* (2013.01); *B02C 13/282* (2013.01); *B02C 2013/2808* (2013.01); *B02C 2013/2816* (2013.01); *B02C 2013/28609* (2013.01); *B02C 2013/28672* (2013.01)

(58) Field of Classification Search

CPC . B02C 2013/2816; B02C 13/14; B02C 13/16; B02C 13/18; B02C 13/1807; B02C 13/1814; B02C 13/1821; B02C 13/28; B02C 13/282

See application file for complete search history.

(56) References Cited

U.S. PATENT DOCUMENTS

| | | | |
|---|---|---|---|
| 2,160,695 | A | 5/1939 | Brannon |
| 4,690,338 | A | 9/1987 | Sayler et al. |
| 5,188,500 | A | 2/1993 | Eide et al. |
| 5,192,029 | A | 3/1993 | Harris |
| 5,340,036 | A | 8/1994 | Riley |
| 5,680,994 | A | 10/1997 | Eide et al. |

(Continued)

*Primary Examiner* — Matthew G Katcoff

(74) *Attorney, Agent, or Firm* — Erickson Kernell IP, LLC

(57) ABSTRACT

A comminution mill is described that includes a vertically oriented cylindrical housing with an intake chute in a top wall and an outlet chute in a bottom wall thereof. A rotatable shaft with a plurality of radially extending cables is disposed coaxially within the cylindrical housing. A plurality of studs extends inwardly from the wall of the housing to slow and collect materials flowing through the comminution mill. The studs can be withdrawn to discharge materials collected thereon. Slits are provided in the walls of the housing to enable the exit of particulate materials from the housing. A hood is provided overlying the slits on the exterior of the comminution mill for collecting the particulate material. Operation of the comminution mill provides a self-generated airflow and can be configured to separate, grind, and dry materials disposed therein.

20 Claims, 17 Drawing Sheets

(56) References Cited

U.S. PATENT DOCUMENTS

| | | | | |
|---|---|---|---|---|
| 5,685,498 | A | 11/1997 | McCoy | |
| 5,685,500 | A | 11/1997 | Eide et al. | |
| 5,692,688 | A | 12/1997 | Waitman et al. | |
| 5,697,563 | A * | 12/1997 | Fujimoto | B02C 13/16 241/102 |
| 6,227,473 | B1 | 5/2001 | Arnold | |
| 6,395,051 | B1 * | 5/2002 | Arnold | B02C 13/18 428/402 |
| 6,726,133 | B2 | 4/2004 | Hahn et al. | |
| 6,991,189 | B2 | 1/2006 | Hahn et al. | |
| 7,055,769 | B2 | 6/2006 | Pierce | |
| 7,950,601 | B2 * | 5/2011 | Watts | B02C 13/1814 241/275 |
| 8,267,337 | B2 * | 9/2012 | Webb | B02C 13/18 241/154 |
| 2009/0126608 | A1 | 5/2009 | Borissov et al. | |

* cited by examiner

COMMINUTION MILL WITH CABLE IMPACT ARMS

CROSS-REFERENCE TO RELATED APPLICATIONS

This application claims the benefit of U.S. patent application Ser. No. 13/623,379, filed Sep. 20, 2012 and U.S. Provisional Patent Application No. 61/881,525, filed Sep. 24, 2013 both titled "Grinding Mill with Cable Grinding Arms," the disclosures of each of which are hereby incorporated herein in their entirety by reference.

BACKGROUND

Grinders, shredders, or comminution mills are well known devices for reducing the particle size of a material. For example, U.S. Pat. No. 5,192,029 to Harris (hereinafter Harris) and U.S. Pat. No. 5,680,994 to Eide et al. (hereinafter Eide) each disclose mills for grinding garbage. Each of theses mills includes a rotor rotatably mounted in a generally octagonal housing. The rotor includes a generally vertical shaft and a plurality of blades or hammers mounted on the shaft. Garbage is admitted into the housing through an inlet near the top of the housing and is impacted by the blades of the rotor. Material of a reduced particle size is removed from the mill through an outlet near the bottom of the housing. The ground garbage can be sent to a landfill where it will take up less room than unprocessed garbage, or it can be composted or recycled depending on the included materials. If the material is to be shipped, it can be shipped more efficiently due to its reduced size and greater density.

The mill of Eide also includes a fan or impeller that is mounted on the rotor shaft below the cutting blades. The fan is intended to create airflow that acts to move material through the mill and to expel it from the outlet. The airflow also aids to remove moisture from the material as it is being ground. The fan generally comprises a fan disc mounted to the rotor shaft. The fan disc includes a plurality of radially extending lengths of angle iron mounted thereon. One flange of each angle iron is fixedly bolted to the fan disc and the other extends upwardly from the disc to act as a fan blade.

Mills such as those described by Harris and Eide have several drawbacks. All or parts of the blades may sheer off during grinding operations. Pieces of the blades can be torn away from the blade via contact with the materials being ground or the blades themselves can be torn or ripped away from their coupling with the rotor. The loose blade portions can damage other blades and components inside the grinder and are likely discharged through the outlet as contaminates in the ground materials. Another drawback to these designs is the need for the fan or impeller to generate airflow through the mill. These add additional components and complexities to the manufacture and maintenance of the mill. It would be advantageous to provide a comminution mill with non-rigid impact blades or impact arms and that does not require a fan or impeller to generate airflow therethrough.

SUMMARY

A high-level overview of various aspects of embodiments of the invention are provided here to provide an overview of the disclosure, and to introduce a selection of concepts that are further described in the Detailed-Description section below. This summary is not intended to identify key features or essential features of the claimed subject matter, nor is it intended to be used in isolation to determine the scope of the subject matter. In brief, this disclosure describes, among other things, a vertical comminution mill or grinder with impact arms comprised of sections of cable.

The comminution mill includes a vertically oriented cylindrical housing with an inlet opening near the top and an outlet near the bottom thereof. A rotatable shaft is disposed in the housing and coaxially therewith. A plurality of mounting plates is affixed in spaced apart relation along the shaft. A plurality of sections of cable, such as high-strength steel crane cable, is attached to each of the plates. Each section of cable is attached along its midsection, such that opposite ends of the cable extend radially outwardly away from the shaft and form impact arms. A plurality of baffles and obstructing members, such as bolts or studs, extend radially inward from a sidewall of the housing and are positioned vertically offset from the mounting plates and cables. The bolts or studs may be coupled at one end to a withdrawal apparatus configured to withdraw the bolts or studs from the interior of the comminution mill to thereby clear debris collected thereon.

In operation, rotation of the shaft and thus, the impact arms, at preferably about 1,700 revolutions per minute (RPM) generates an airflow through the comminution mill that exits the outlet at about twenty miles per hour (MPH) without the use of fan blades or impellers.

Materials are deposited into the comminution mill through the inlet and are ground, milled, pulverized, or otherwise reduced to smaller particulate sizes by contact with the impact arms. The baffles and obstructing members direct and obstruct the vertical and circumferential flow of the material to aid in comminution by the impact arms. Contact with the impact arms and the airflow in the comminution mill may also aid to separate and segregate dissimilar materials. For example, the action of the comminution mill on plastic bottles placed therein may separate lids, labels, sealing members, and bottle bodies from one another. A plurality of comminution mills might also be placed in series to further aid separation of materials placed therein.

The cable sections provide flexibility to avoid shearing or destruction of the impact arms during comminution and can be easily replaced. Ends of the cable sections can include collars or weldments that aid in comminution and decrease fraying of the cable.

The comminution mill may also be configured to separate and collect dust or fine particulate materials that are liberated during comminutinon. A plurality of slots, slits, or other apertures can be disposed in the sidewalls or bottom wall of the comminution mill. Airflow and/or centrifugal forces generated during comminution carries the fine particulate through the apertures. One or more hoods or chambers can be disposed on the exterior of the comminution mill overlying the apertures to collect the fine particulate materials.

DESCRIPTION OF THE DRAWINGS

Illustrative embodiments of the invention are described in detail below with reference to the attached drawing figures, and wherein.

DETAILED DESCRIPTION

Figure 1:
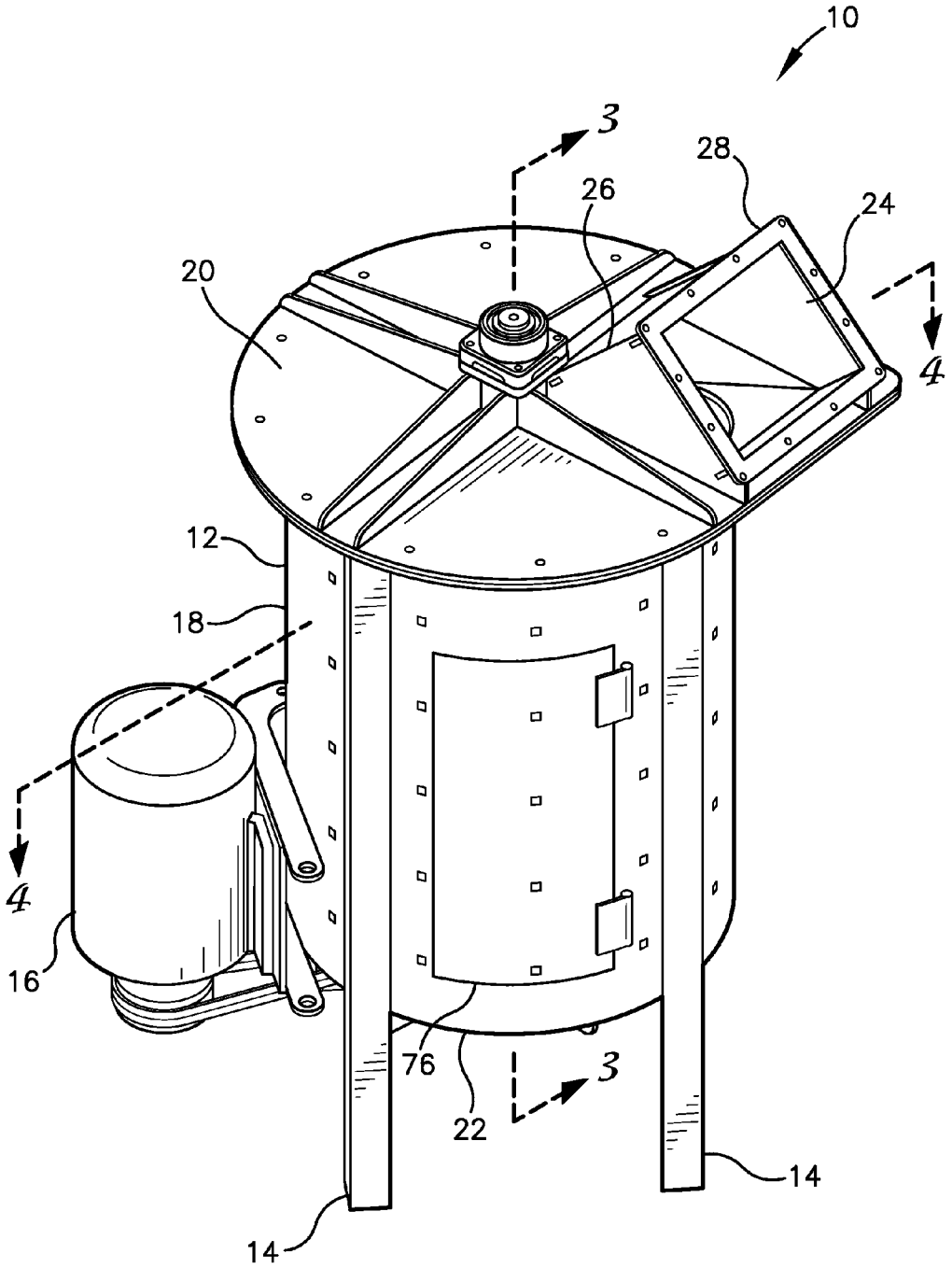
FIG. 1 is a perspective front side view of a comminution mill depicted in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different steps, components, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention are described herein with respect to the drawings in which reference numerals are employed to identify particular components or features. Corresponding elements in the various embodiments depicted are provided with corresponding reference numerals. Such is provided to avoid redundant description of similar features of the elements but is not intended to indicate the features or elements are necessarily the same.

With reference to FIGS. 1-5, a comminution mill 10 is described in accordance with an embodiment of the invention. The mill 10 comprises a housing 12, with a plurality of legs 14, and a motor 16 coupled thereto. The legs 14 comprise any structures suitable to support the mill 10 during operation thereof. As shown in FIGS. 1-5, the legs 14 comprise sections of angle iron welded to the exterior of the housing 12. The motor 16 is mounted to the exterior of the housing 12 and comprises a motor available in the art that is suitable to provide operation of the mill 10 as described herein, e.g. an electric or hydraulic motor.

The housing 12 is substantially cylindrical with an annular wall 18 extending vertically between a top end-wall 20 and bottom end-wall 22. The mill 10 is described herein as comprising a vertically oriented comminution mill however, other orientations of the mill 10 or housing 12 might be employed in embodiments of the invention.

The top end-wall 20 includes an intake chute 24 or other opening through which materials to be ground can be deposited into the mill 10. The intake chute 24 includes a passageway 26 that extends from the top end-wall 20 at an angle and may be curved to follow an arcuate path into the housing 12. The passageway 26 aids to direct materials entering the housing 12 along the arcuate path and in a generally horizontal or downward spiraling direction, e.g. the materials do not simply drop vertically through the housing 12. The passageway 26 might induce cyclonic action or flow of the materials within the housing 12. The intake chute 24 includes a mounting flange 28 along a distal edge thereof for mounting to material delivery components, such as conveyors, ducting, or the like (not shown). A lower wall 27 of the passageway 26 may extend below the top end-wall 20 and within or exterior to the annular wall 18 to further direct the materials along the arcuate path.

Figure 2:
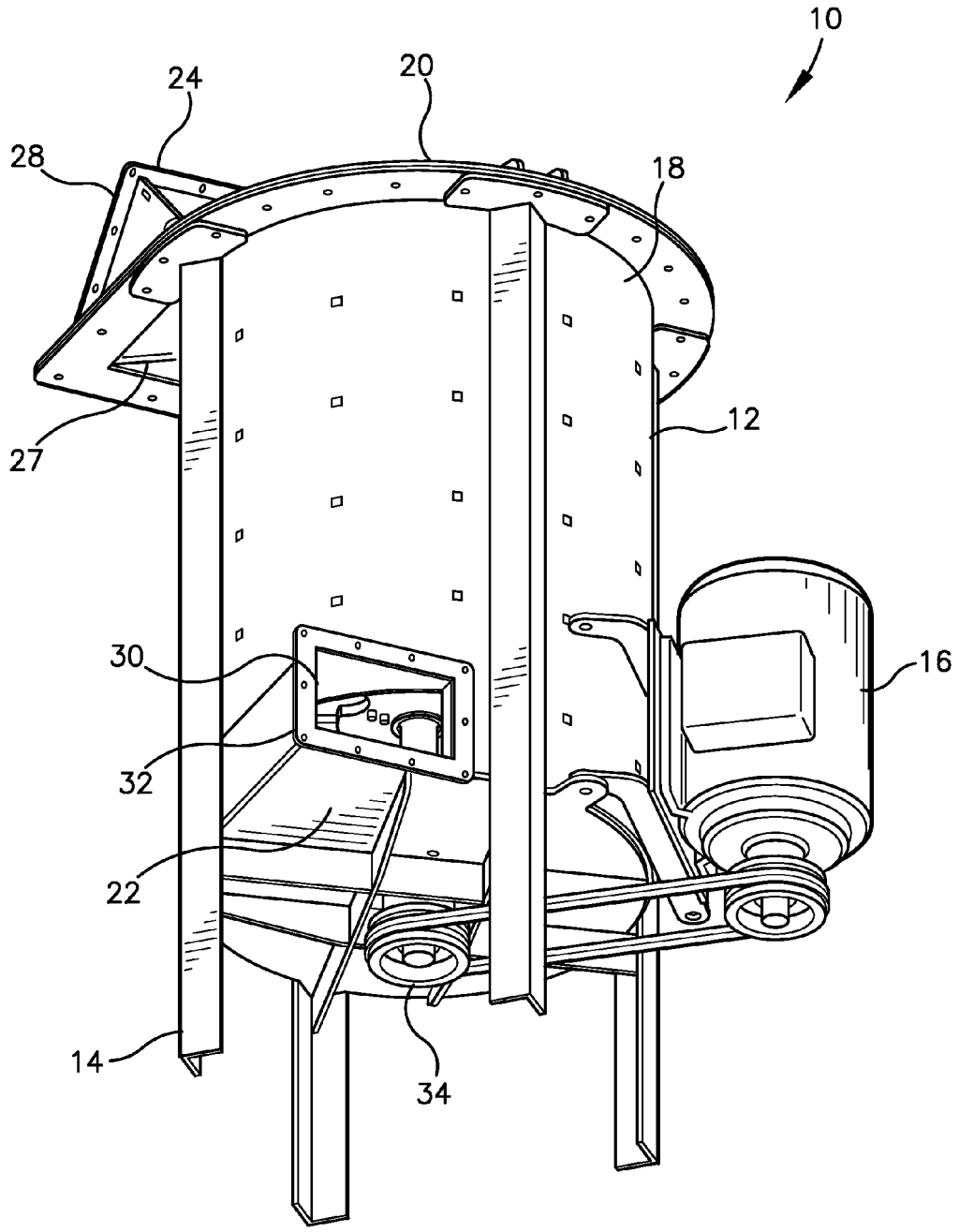
FIG. 2 is a perspective back side view of the comminution mill of FIG. 1.
Figure 3:
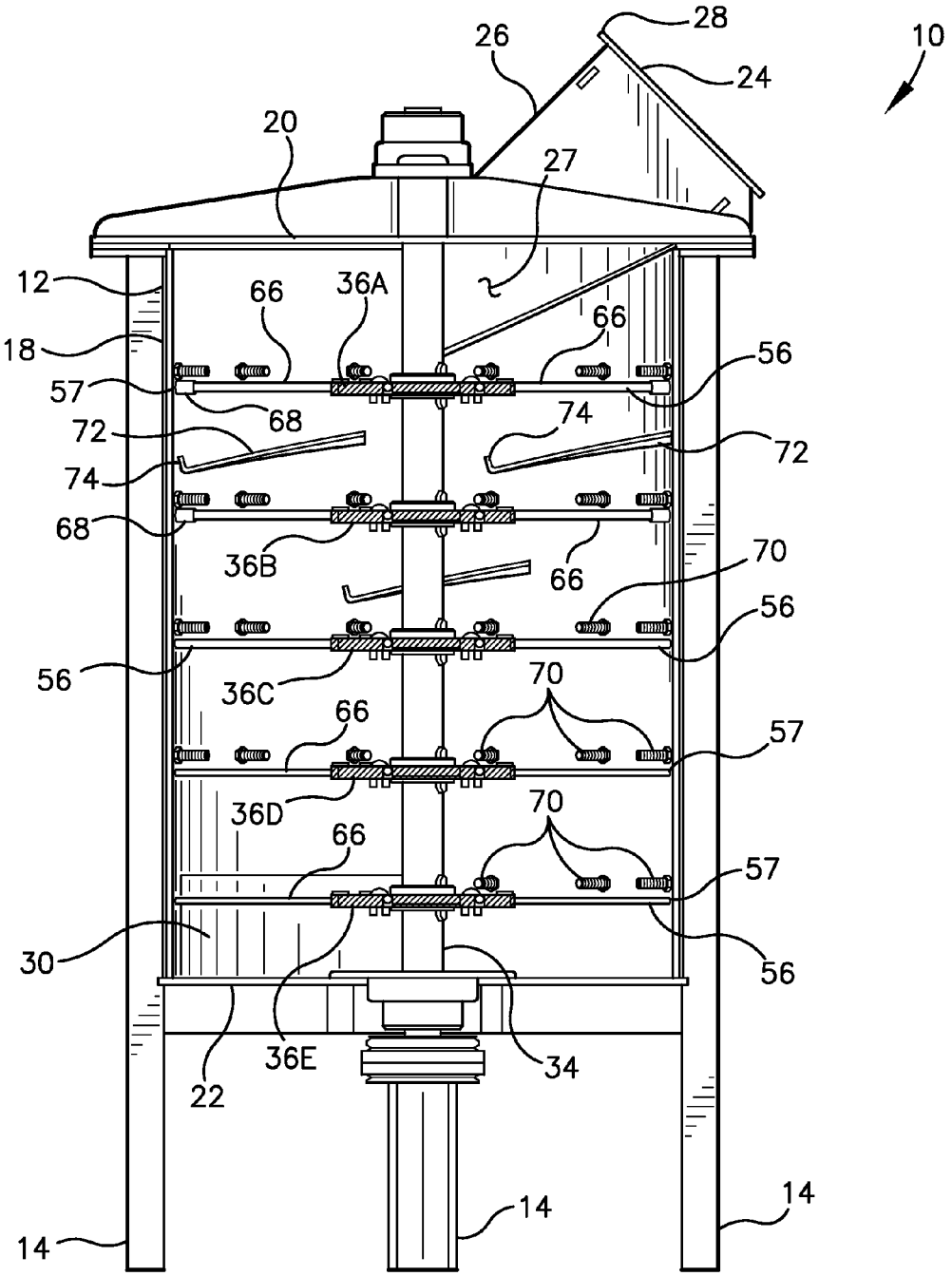
FIG. 3 is an elevational cross-sectional view taken along the line 3-3 depicted in FIG. 1.
Figure 4:
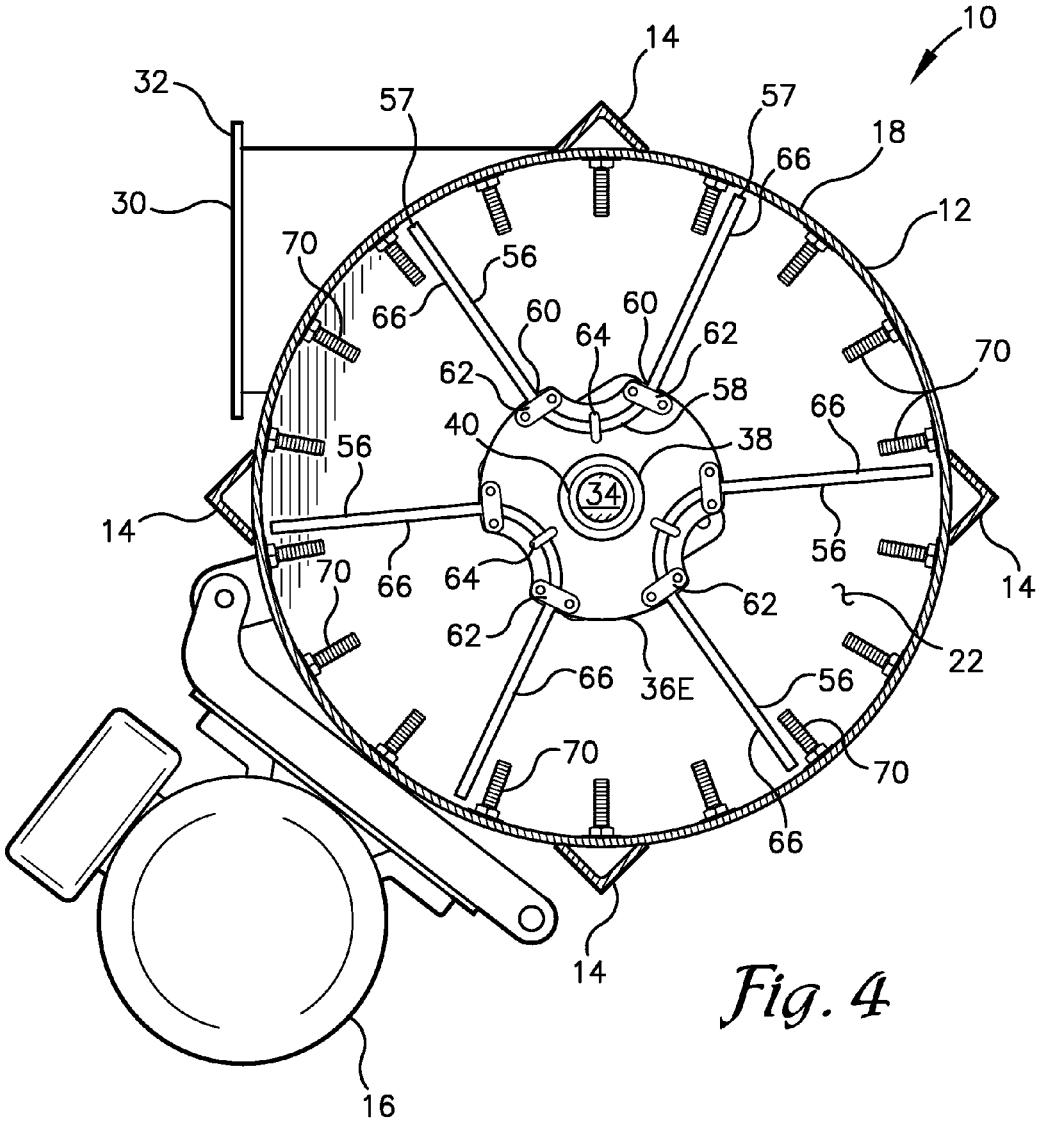
FIG. 4 is a cross-sectional plan view taken along the line 4-4 depicted in FIG. 1.

An outlet chute 30 is disposed adjacent to or is integral with the bottom end-wall 22. As depicted in FIGS. 2-4, the outlet chute 30 extends tangentially from the annular wall 18 of the housing 12 with the bottom end-wall 22 forming a bottom wall thereof. The outlet chute 30 is configured to allow ground particulate materials traveling in a generally circular or spiraling path inside the housing 12 to exit the housing 12 along a generally tangential path and pass or flow to downstream material handling equipment or containers (not shown).

Figure 6:
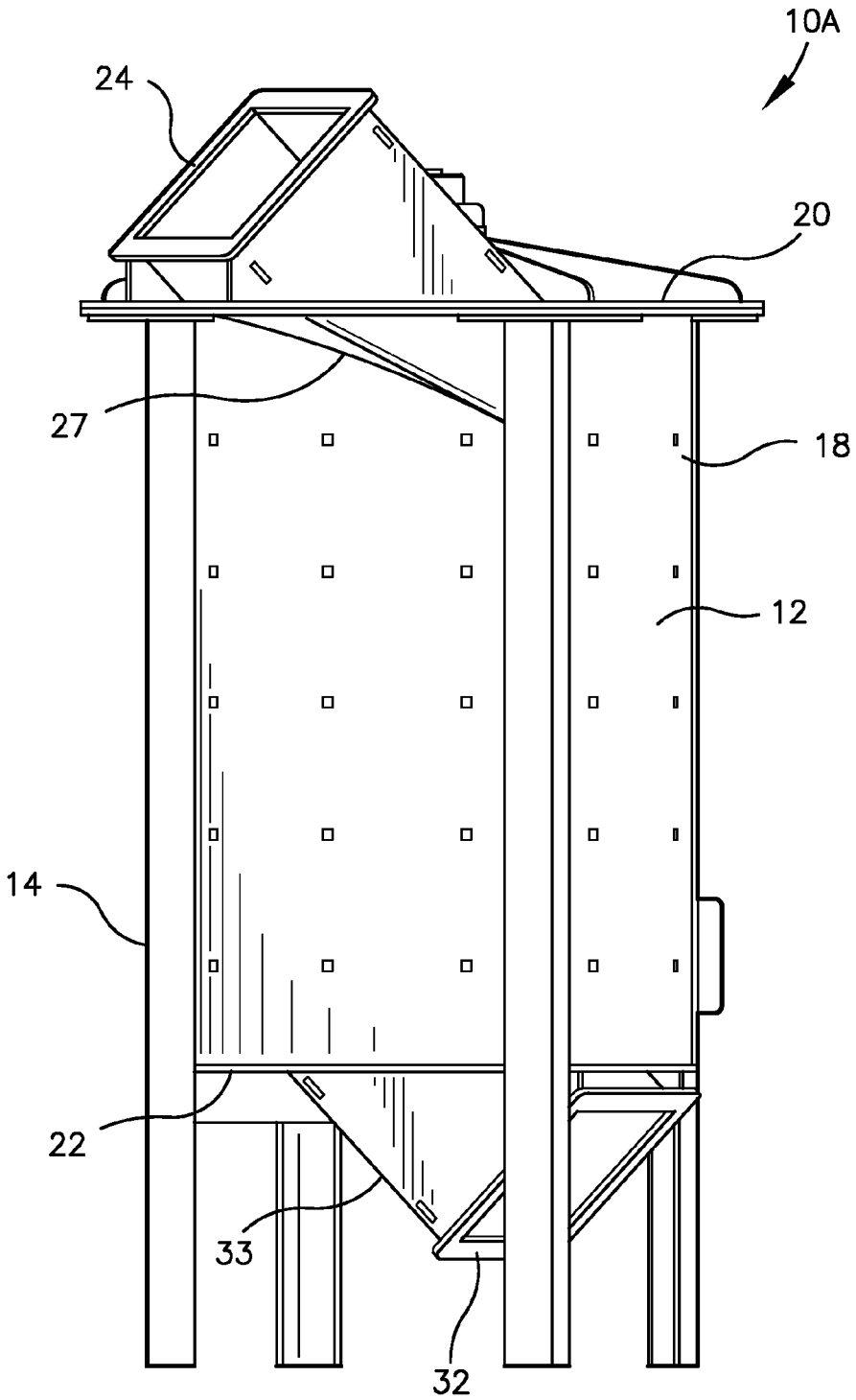
FIG. 6 is front perspective view of a comminution mill with an exit chute or funnel extending from a bottom surface in accordance with an embodiment of the invention.

The outlet chute 30 may also include a flange 32 along a distal edge for coupling to the downstream material handling equipment or containers. In another embodiment, depicted in FIG. 6, an outlet chute 33 extends through the bottom end-wall 22 along an angled and/or curved path similar to that of the intake chute 24 or might comprise a funnel-shaped portion of the bottom end-wall 22, as depicted by the outlet chute 33 of the mill 10A. Extension of the outlet chute 33 from the bottom end-wall 22 may provide better material flow for wet or moist materials.

Figure 13A:
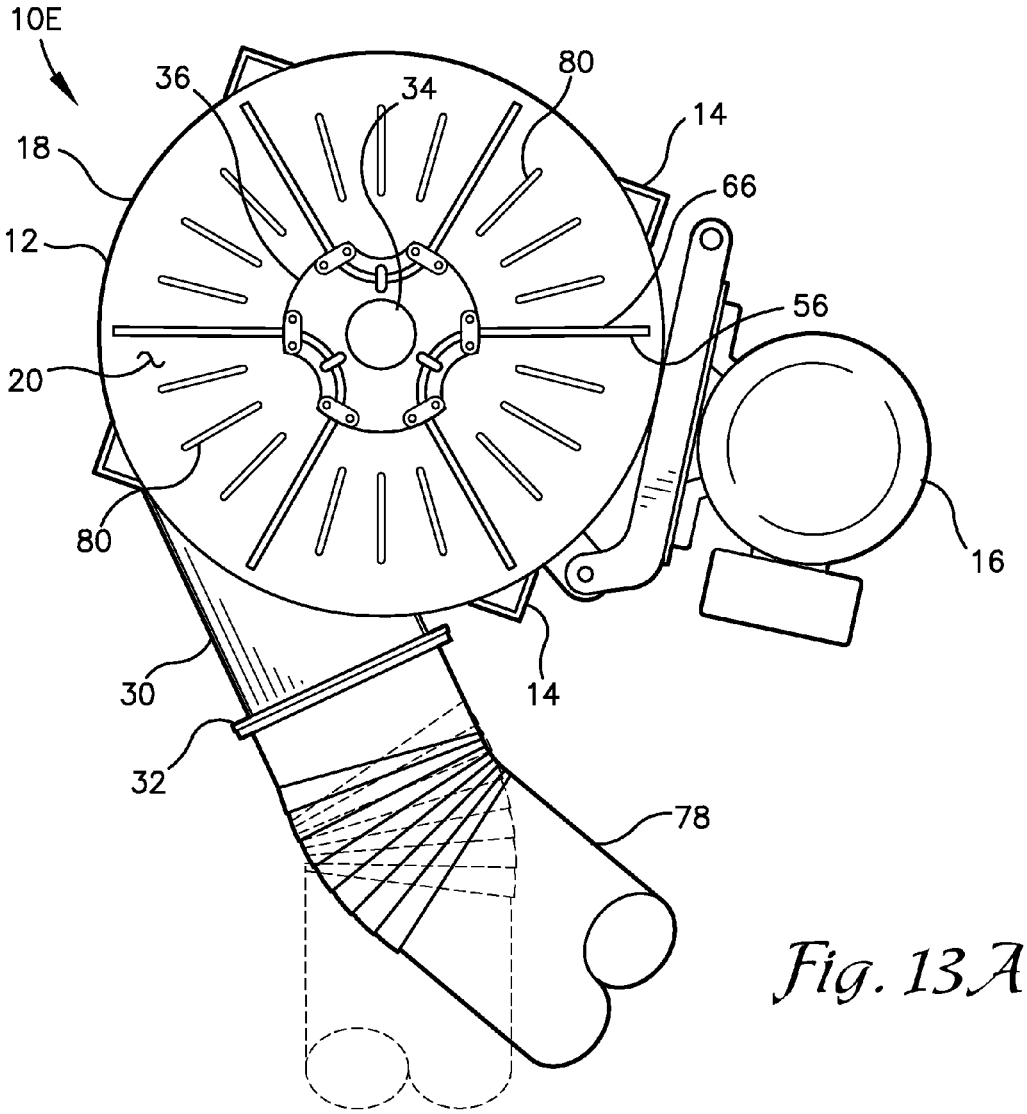
FIG. 13A is a top plan view of the interior of a comminution mill showing the interior bottom portion of the comminution mill and a flexibly positionable exit chute depicted in accordance with an embodiment of the invention.

In an embodiment depicted in FIG. 13A, the outlet chute 30 includes a selectively positionable extension chute 78 that can be pivoted side-to-side and/or vertically to align with a selected downstream receiving basin (not shown). As such, portions of ground or separated materials exiting the mill 10E can be selectively discharged to a desired receiving basin by aligning the extension chute 78 with the desired basin.

Figure 13B:
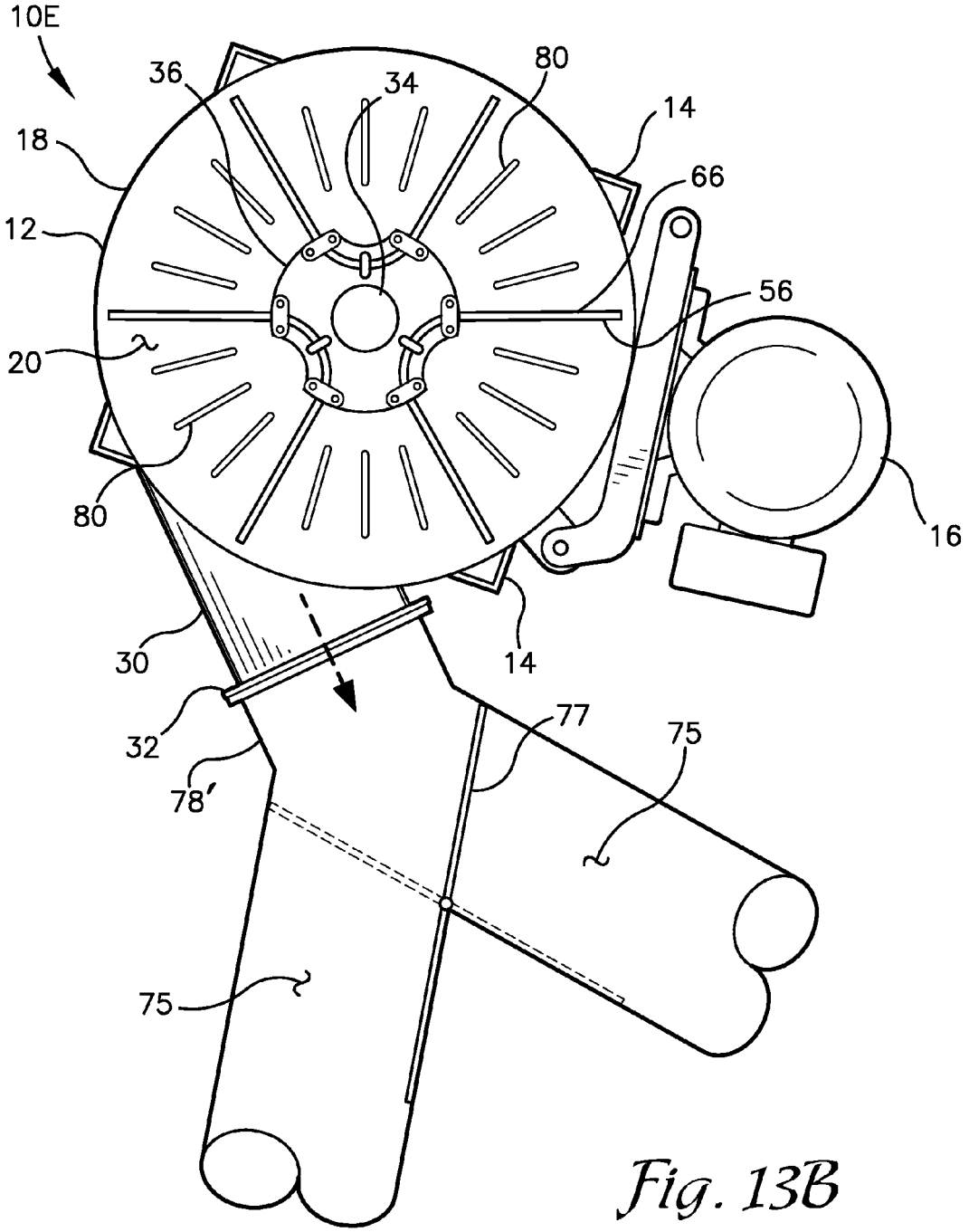
FIG. 13B is a top plan view of the interior of a comminution mill showing the interior bottom portion of the comminution mill and an exit chute with a selectively positionable baffle depicted in accordance with an embodiment of the invention.

In another embodiment, the outlet chute 30 is connected to an extension chute 78' that is divided into two or more pathways 75 with a selectively positionable baffle 77 disposed at their intersection, as depicted in FIG. 13B. The baffle 77 is moveable between at least two positions to divert ground or separated materials exiting the mill 10E along a selected one of the pathways 75.

Figure 13C:
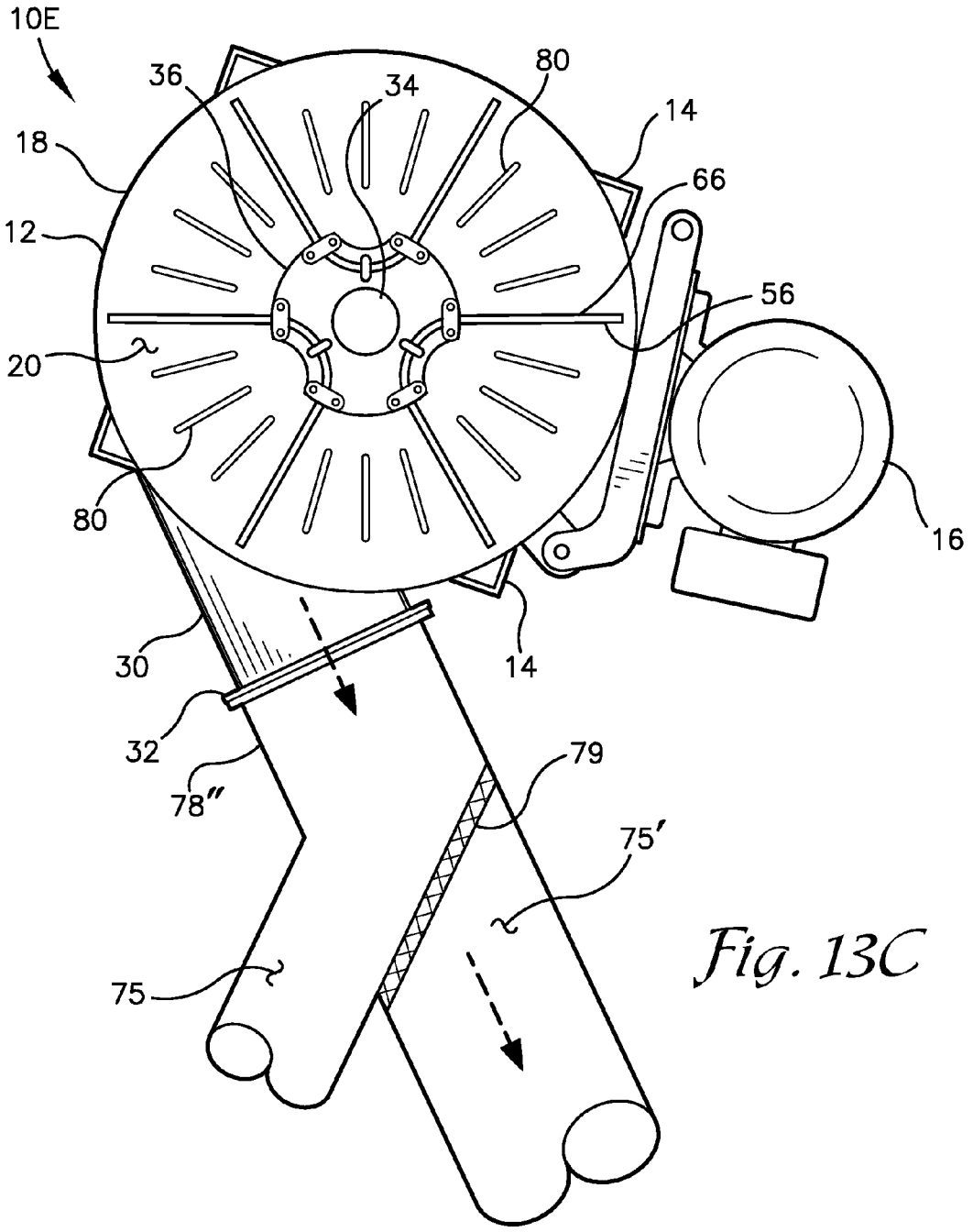
FIG. 13C is a top plan view of the interior of a comminution mill showing the interior bottom portion of the comminution mill and an exit chute with a diverting screen depicted in accordance with an embodiment of the invention.

In another embodiment depicted in FIG. 13C, the outlet chute 30 is connected to another extension chute 78" that is also divided into at least two pathways 75 and 75'. A screen 79 or other filtering means obstructs flow into a first of the pathways 75' while the second pathway 75 remains unobstructed. The screen 79 is configured to allow passage of smaller particulate in the ground or separated materials exiting the mill 10E into the first pathway 75' and to divert larger particulate materials into the second pathway 75. The screen 79 may be positioned within the extension chute 78" at an angle that is not perpendicular to the pathways 75, 75' to resist collection of larger particulate materials on the screen 79 and to aid movement thereof into the second pathway 75.

A shaft 34 is rotatably mounted within the housing 12 and coaxially therewith. The shaft 34 is rotatably coupled to the top and bottom end-walls 20, 22 and extends through the bottom end-wall 22 to mechanically couple to the motor 16 via one or more of belts, chains, sprockets, gears, or the like. The shaft 34 is thereby rotatable by the motor 16.

Figure 5:
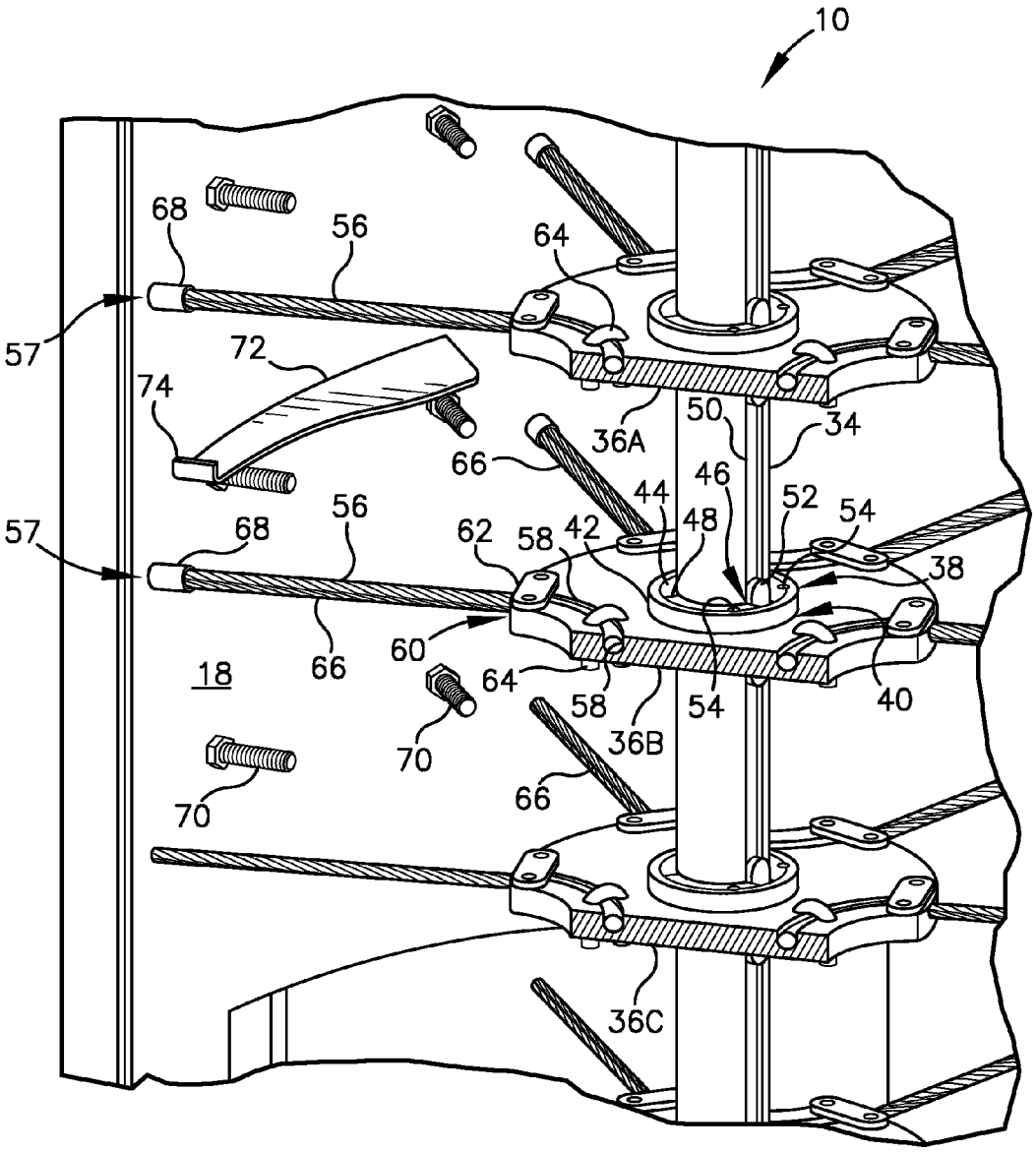
FIG. 5 is a enlarged partial cut-away perspective view of components in the interior of the comminution mill depicted in FIG. 1.

Referring to FIGS. 3-5, a plurality of mounting plates 36 is disposed along the length of the shaft 34. The mounting plates 36 are evenly spaced apart along the length of the shaft 35 inside the housing 12 or can be located along the length as desired. The mounting plates 36 are coupled to the shaft 34 via taper-lock hubs 38, as best seen in FIG. 5. Each of the mounting plates 36 includes a central bore 40 in which an outer ring 42 of the taper-lock hub 38 is disposed and fixedly coupled therein, such as by welding. The outer ring 42 includes an interior diameter that is greater than the diameter of the shaft 34.

The hub 38 also includes an inner ring 44 that has a keyway 46 and a split 48 that allows the ring 44 to be flexed or compressed to decrease the diameter thereof. The outer circumference of the inner ring 44 is tapered and is configured for receipt by a mating tapered surface of the outer ring 42. As such, the mounting plate 36 is positioned at a desired location along the length of the shaft 34; the inner ring 44 is inserted between the outer ring 42 and the shaft 34. The keyway 46 of the inner ring 44 is aligned with a keyway 50 in the shaft 34 and a key 52 inserted therein to maintain rotational alignment between the shaft 34 and the inner ring 44. A plurality of fasteners 54 are inserted into the outer ring 42, the heads thereof engaging the inner ring 44 to draw the inner ring 44 into the space between the outer ring 42 and the shaft 34 and to compress the inner ring 44 against the shaft 34.

The mounting plates 36 are generally circular in shape and are each configured to retain a plurality of comminuting members or cables 56 evenly spaced about the circumference thereof. The mounting plates 36 are described herein using three cables 56 each. However, it is understood that any number of cables 56 and associated components might be employed in embodiments of the invention without departing from the scope described herein. Further, the number of cables 56 coupled to each of the mounting plates 36 can be different, e.g. one mounting plate 36 might have five cables 56 while another might only have two cables 56.

The cables 56 preferably comprise high-strength steel cable, such as that known as crane cable or aircraft cable or may comprise any desired cable, wire, rope, or similar braided or non-braided strands. The cables 56 coupled to a particular mounting plate 36 preferably all have the same diameter so as to provide even weight distribution across the mounting plate 36 but other arrangements might be used. All of the mounting plates 36 can use cables 56 of the same diameter or the cables 56 can be varied. For example, as depicted in FIGS. 3 and 5, the cable diameter decreases from an uppermost mounting plate 36A to a bottom mount plate 36E, e.g. the uppermost mounting plate 36A employs 0.5 inch diameter cables 56 while the succeeding lower mounting plates 36B-E use 0.5 inch, 0.375 inch, 0.25 inch, and 0.125 inch diameter cables respectively. Other configurations are understood as being within the scope of embodiments of the invention described herein.

Each cable 56 is coupled to a respective mounting plate 36 along a midsection thereof. The cable 56 is curved, bent, or folded at an angle such that opposite ends 57 thereof extend radially outward from the mounting plate 36 toward but not contacting the annular wall 18. The cable 56 is preferably curved at an acute angle of approximately about 60 degrees but may be bent into any acute, right, or obtuse angle as desired. In another embodiment, the cables 56 are substantially linear and are coupled to the mounting plate 36 such that opposite ends 57 of the cable 56 extend in opposite directions from opposite sides of the mounting plate 36. Or the cables 56 might be coupled to the mounting plate 36 with only a single end 57 extending therefrom.

For each of the cables 56, an arcuate, parabolic, or otherwise curved channel 58 is formed in a surface, generally the upper surface, of the mounting plate 36. The channel 58 is configured to accept one of the cables 56 therein. Ends 60 of the channel 58 are open to the circumference of the mounting plate 36 to allow the cable 56 to extend radially outward through the circumference. In another embodiment, the cables 56 are mounted on a surface of the mounting plate 36 without the use or provision of the channels 58. The channels 58 and their respective ends 60 are evenly spaced about the circumference of the mounting plate 36.

A retaining bracket 62 is positioned in overlying relationship with the channel 58 adjacent to each end 60 thereof and is retained in position by one or more fasteners. The retaining brackets 62 function to retain the cable 56 within the channel 58 and may clamp or compress the cable 58 therein. A U-bolt 64 or similar clamping feature is disposed at an apex of each channel 58 or at another location along the length of the channel 58. The U-bolt 64 extends through holes in the mounting plate 36 on opposite sides of the channel 58. The bite or cross-member of the U-bolt extends over the cable 56 for clamping, compressing, or otherwise anchoring the cable 56 to the mounting plate 36.

Figure 7A:
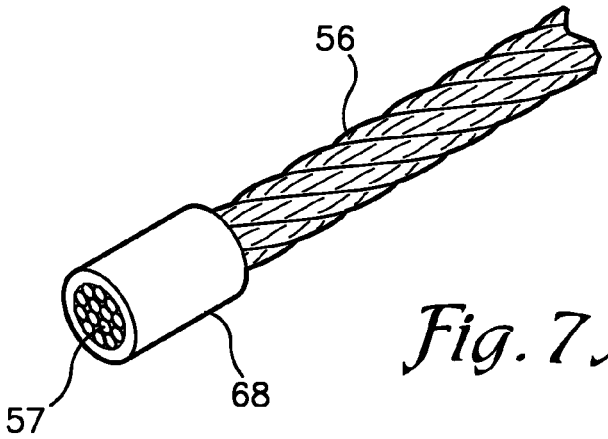
FIGS. 7A-C are perspective views of distal ends of cables employed in a comminution mill in accordance with an embodiment of the invention.
Figure 7B:
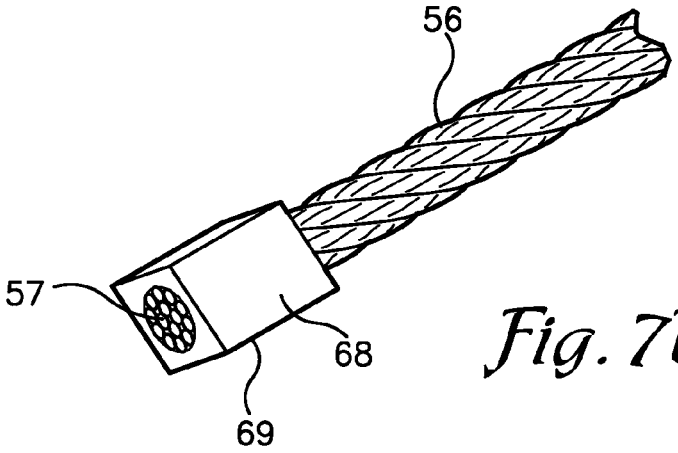
Figure 7C:
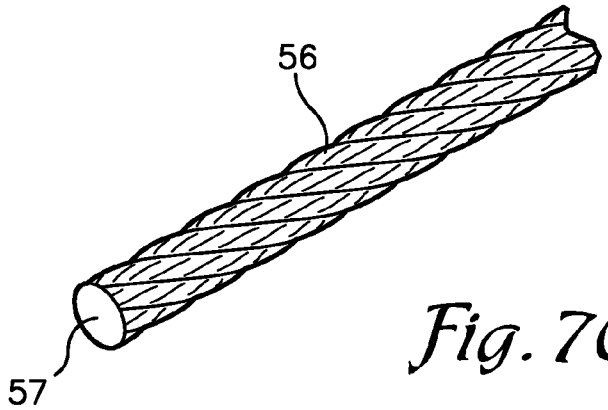

The portions of the cable 56 that extend from the mounting plate 36 form impact arms 66 that contact and comminute materials deposited in the mill 10 as described more fully below. The ends 57 of the cables 56 include a collar 68 or other component coupled thereto, as depicted in FIGS. 7A-B. The collar 68 may comprise a hollow metallic cylinder or other form that is crimped, welded, or otherwise affixed around the end 57 of the cable to provide additional weight to the cable ends 57 and to restrict fraying of the ends 57 during comminution. The collar 68 might also be configured with a tapered or sharpened leading edge 69 as shown in FIG. 7B to aid in cutting of materials during comminution. The strands of the cable 56 can also be welded or melted together at the ends 57 to resist fraying as depicted in FIG. 7C.

Figure 7D:
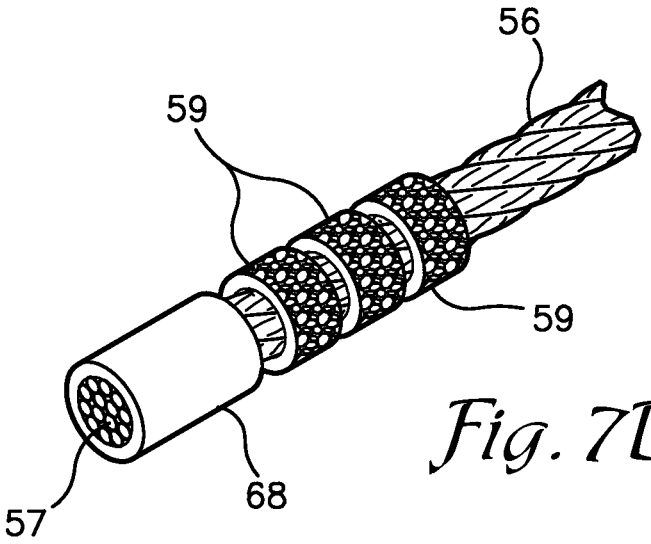
FIG. 7D is a perspective view of a distal end of a cable with a plurality of abrasive rings disposed thereon in accordance with an embodiment of the invention.
Figure 7E:
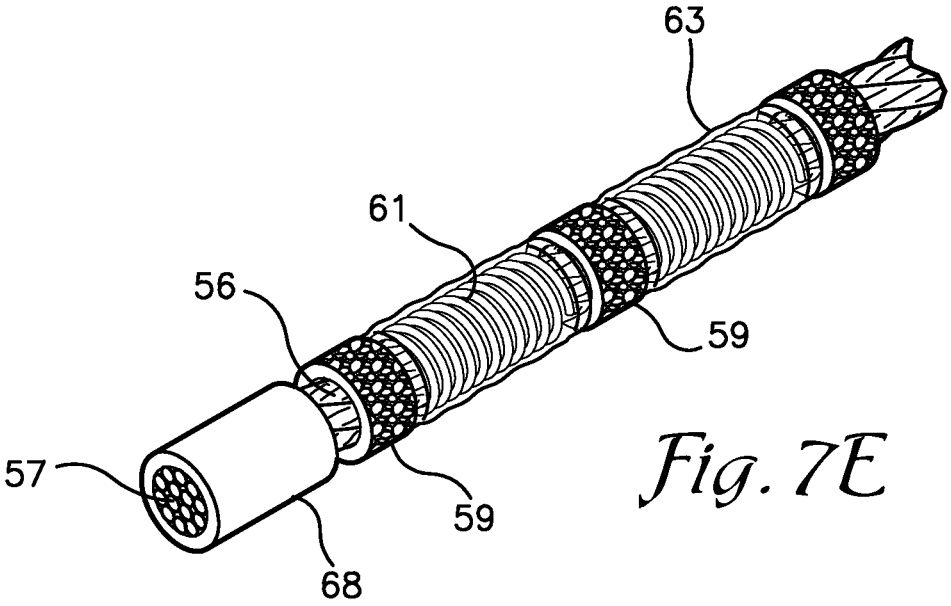
FIG. 7E is a perspective view of a distal end of a cable with a plurality of abrasive rings and spacers disposed thereon in accordance with an embodiment of the invention.

In another embodiment, the impact arms 66 are provided with one or more abrasive rings 59 disposed along the length of the impact arms 66, as depicted in FIGS. 7D-E. The abrasive rings 59 preferably comprise a metallic ring substrate impregnated with diamond or another abrasive component or compound, but other substrates may be employed. The abrasive rings 59 may be free-floating on the impact arms 66 such that they can rotate and move freely along the length of the arms 66. The abrasive rings 59 may thus be forced toward the end 57 of the arm 66 by centrifugal forces generated by operation of the mill 10. This provides additional mass near the end 57 of the impact arm 66 to increase the force or inertia exerted on materials when struck by the arms 66. The abrasive rings 59 may provide additional abrasion or grinding action between the impact arms 66 and the materials to be ground.

As shown in FIG. 7E, spacers 61 may be provided to space the abrasive rings 59 along the length of the impact arms 66. The spacers 61 preferably comprise a coil spring disposed between adjacent abrasive rings 56 but can take a variety of other configurations including, for example, tubes or beads. The coil spring spacers 61 can be coated, such as with a plastic or rubber coating 63, to at least partially and temporarily protect the spacers 61 from abrasion caused by contact with the materials to be ground. An exemplary cable with diamond impregnated abrasive rings and spacers is Diamond Wire provided by Diteq Corporation of Lenexa, Kans. The abrasive rings 59 might alternatively be spaced along the impact arms 66 by crimping, welding, or otherwise affixing the abrasive rings 59 to the cable 56 or by providing a protuberance (not shown), such as a weld bead or a crimp on the cable 57 to prevent the abrasive ring 59 from moving along the length of the arms 66.

Cutouts 67 may be formed in each mounting plate 36 to conserve material. In the embodiment shown, a cutout 67 is formed between the impact arms 66 of the curved or bent cable 56.

Figure 17:
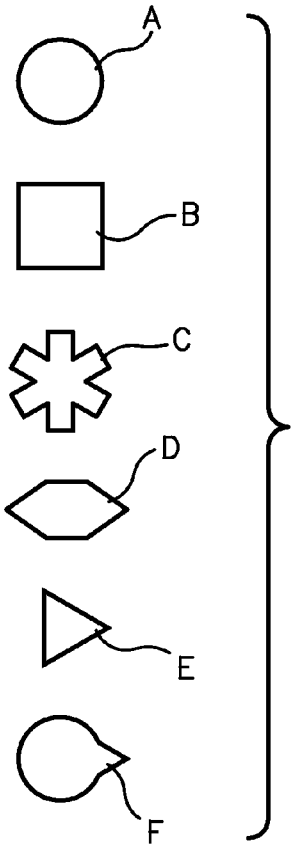
FIG. 17 depicts views of exemplary end profiles A-F of studs useable in a comminution mill configured in accordance with an embodiment of the invention.

As depicted in FIGS. 3-5, the housing 12 also includes a plurality of obstructing members or studs 70 that extend inwardly from an interior surface of the annular wall 18. The studs 70 comprise bolts, flanges, or other features and may include one or more splines, ridges, ribs, or other surface features about their circumference, a variety of such configurations is depicted in FIG. 17 by studs A-F. The surface features can aid retention of materials on the studs 70 such that larger sections of the material can be held while the cables 56 repeatedly impact and break apart the material. The surface features may also provide sharp edges that aid cutting of the materials as the materials travel circumferentially around the interior of the mill 10.

The studs 70 are arranged about the interior surface of the annular wall 18 in vertically spaced apart horizontal planes or in another desired arrangement. The horizontal planes are vertically offset from the mounting plates 36 such that the cable ends 57 do not contact the studs 70 during comminution. But the path of the cable ends 57 overlaps with the studs 70 and the cable ends 57 come into close proximity to the studs 70 during comminution.

A plurality of fins or baffles 72 may also be provided along the interior surface of the peripheral wall 18. They baffles 72 comprise generally triangular or rectangular flanges extending radially inwardly from the peripheral wall 18. The baffles 72 are disposed vertically offset from the mounting plates 36 to avoid contact between the baffles 72 and the ends 57 of the cables 56 during comminution. The baffles 72 extend a distance along the annular wall 18 in a generally horizontal orientation or may be angled slightly downward to aid in directing airflow and/or materials in a spiraling or cyclonic path through the housing 12. One or more baffles 72 can be provided between each of the mounting plates 36 or only between a selection of the mounting plates 36, e.g. only between the mounting plates 36A and B and between mounting plates 36B and C.

A tab or endplate 74 is optionally provided along a trailing edge of the baffle 72 and extends generally perpendicularly thereto. The endplate 74 acts to slow the airflow and/or the flow of materials around the interior of the housing 12.

An access hatch or door 76 is provided along the annular wall 18. The door 76 provides access to the interior of the housing 12 to allow clearing of debris, replacement of cables 56, and other general maintenance.

With reference now to FIGS. 8-13C, a plurality of slits 80, apertures, holes, or the like may be provided in the annular wall 18 or bottom end-wall 22 of the mill 10B-E to aid collection of fine particulate material or dust liberated by the comminution operation. The fine particulate material is generally defined as materials having a particle size less that approximately 1.0 millimeter or, more preferably, less than approximately 100.0 micrometers. The slits 80 can take any form suitable to enable fine particulate material to pass through the walls 18, 22 for collection outside the housing 12.

Figure 8:
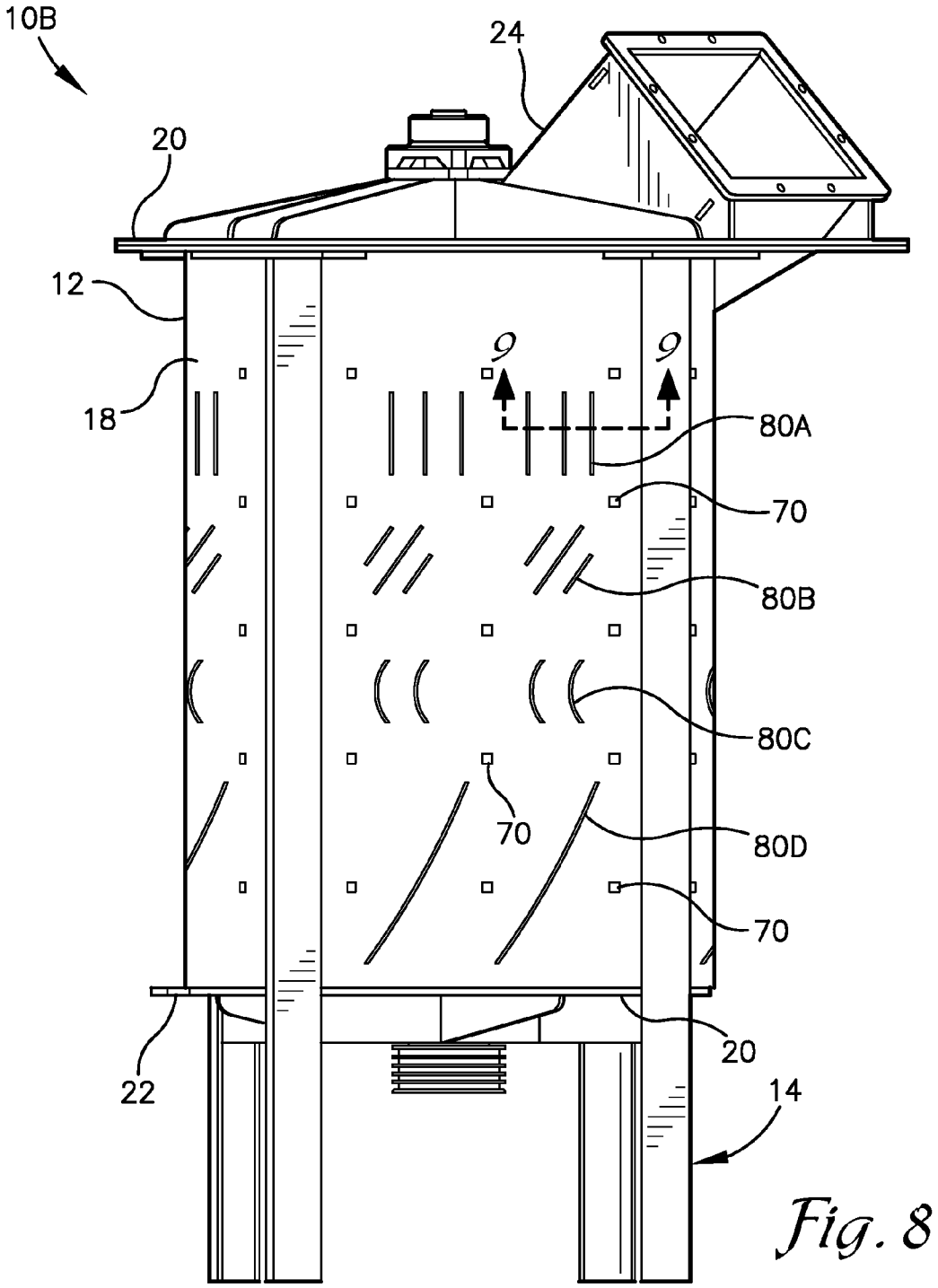
FIG. 8 is a side elevational view of another comminution mill having a variety of exemplary styles of apertures disposed in a sidewall thereof depicted in accordance with an embodiment of the invention.

A variety of exemplary slit configurations are depicted in FIG. 8 in which the slits 80 are shown comprising vertical slits 80A, diagonal cuts 80B, and arcuate apertures 80C-D, all of which are referred to generally herein as slits 80. The slits 80 can extend along the annular wall 18 within a space that is between adjacent levels of the studs 70 or the slits 80 might extend across two or more levels of the studs 70 as shown by the slits 80D. The slits 80 may be provided about the entire annular wall 18 and/or bottom end-wall 20 or can be provided in only selected locations, e.g. only near the bottom of the housing 12.

Figure 9:
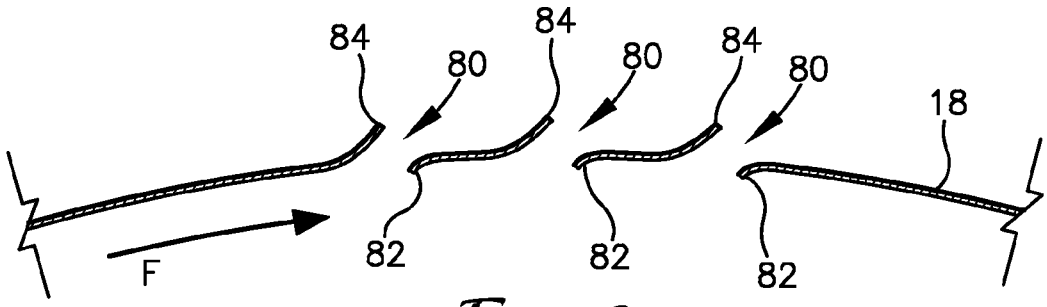
FIG. 9 is a cross-sectional view taken along the line 9-9 in FIG. 8 depicting a plurality of the apertures.

In an embodiment depicted in FIG. 9, the slits 80 are formed to provide a small raised lip 82 that at least partially extends into the housing 12. The raised lip 82 extends at an acute angle into the circumferential flow path (F) of air and material within the housing 12 to collect or divert fine particulate materials through the slit 80 and out of the housing 12. The slits 80 also include an outer edge 84 that bends outwardly away from the wall 18, 20 so as to provide the slit 80 with an opening that increases in width as it extends outwardly from the housing 12. Such an increasing width is intended to provide self-cleaning or anti-clogging characteristics to the slits 80.

Figure 10A:
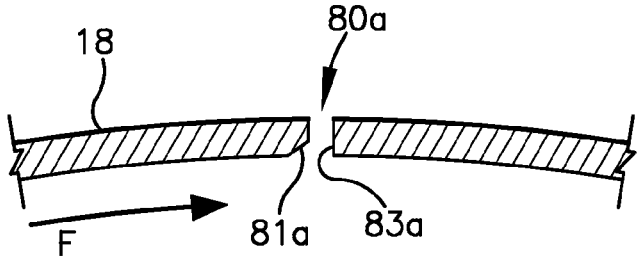
FIGS. 10A-C are enlarged cross-sectional views of alternative configurations of the slits depicted in FIG. 9.
Figure 10B:
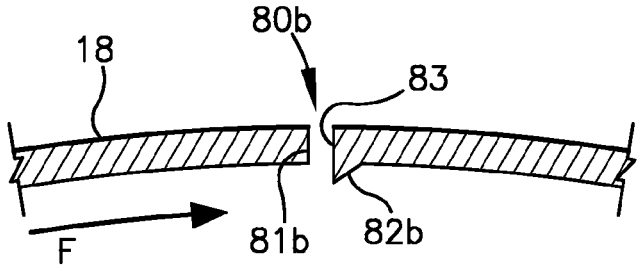
Figure 10C:
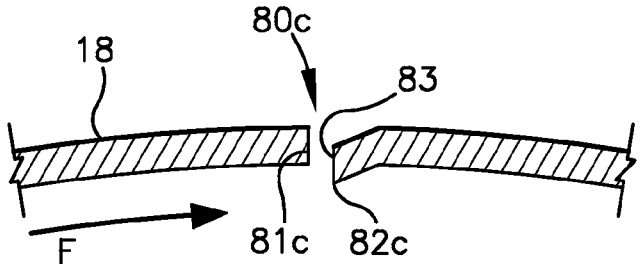

FIGS. 10A-C depict alternative profiles of the slits 80 that might be employed in embodiments of the invention. FIG. 10A depicts a slit 80*a* in which an edge 81*a* of the annular wall 18 leading into the slit 80*a* is at least partially recessed to increase exposure of the opposing side 83*a* of the slit 80*a* to the airflow F. As shown in FIG. 10B, the opposing side 83*b* of a slit 80*b* includes a raised lip 82*b* that extends into the airflow F. And an opposing side 83*c* of a slit 80*c* is offset from the edge 81*c* of the annular wall 18 to thereby form a lip 82*c*, as depicted in FIG. 10C. Any of the slits 80, 80*a*,

80*b*, and 80*c* might be employed alone or in combination in embodiments of the invention.

Figure 11:
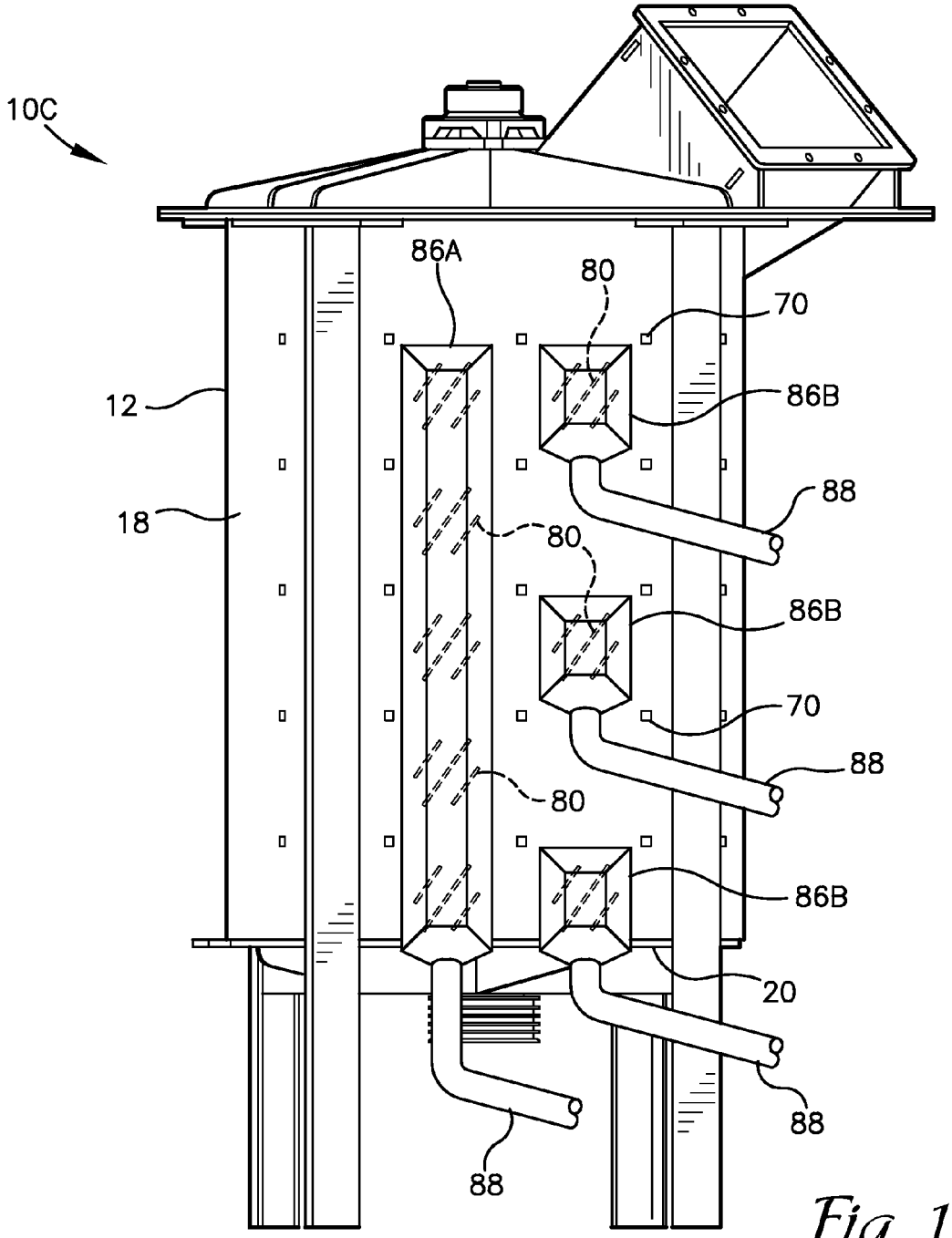
FIG. 11 is a side elevational view of a comminution mill with a plurality of dust-collection chambers overlying apertures in the sidewall of the comminution mill depicted in accordance with an embodiment of the invention.
Figure 12:
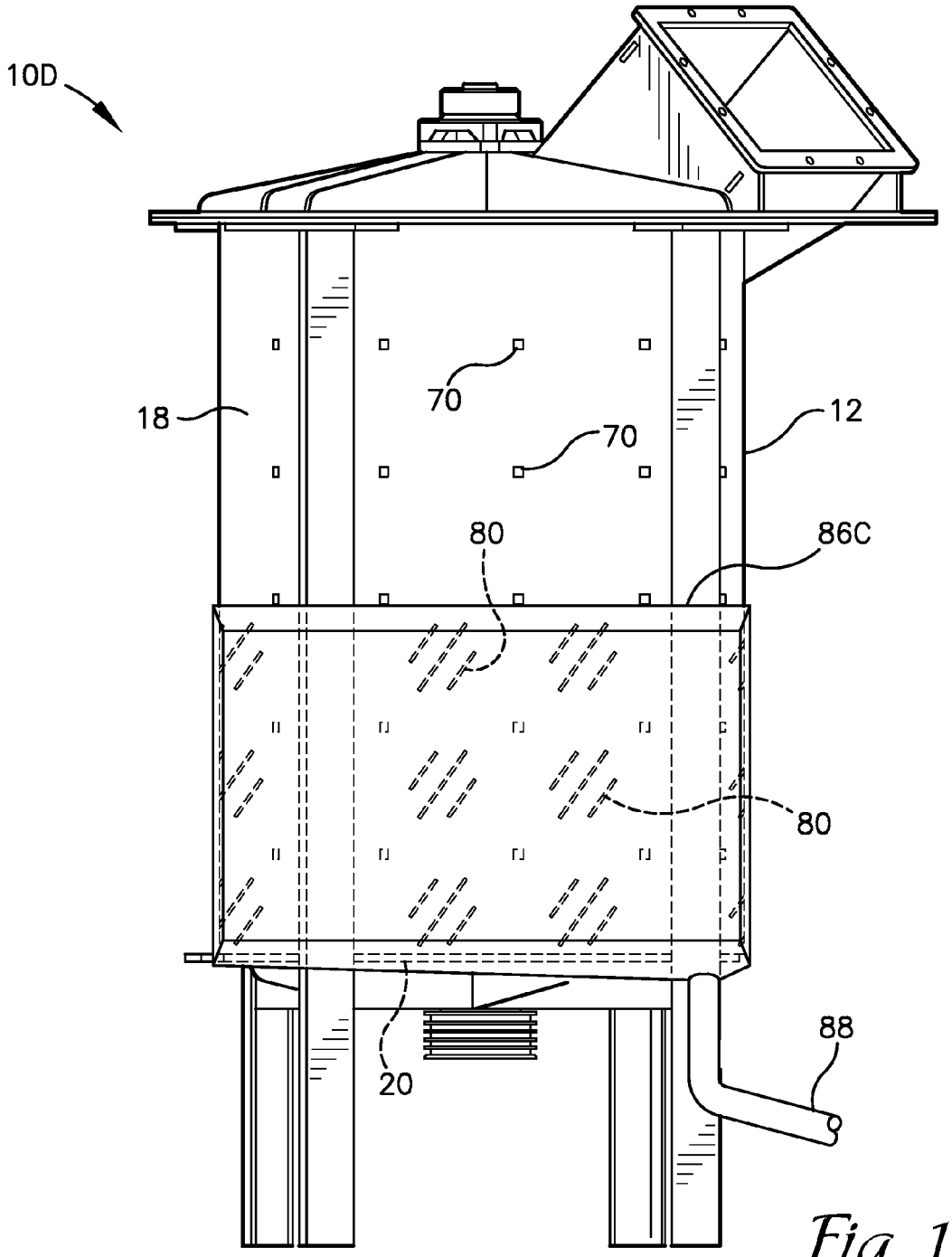
FIG. 12 is a side elevational view of a comminution mill with a dust-collection chamber enclosing a lower portion and bottom of the comminution mill depicted in accordance with an embodiment of the invention.

Dust-collection hoods 86 are provided along the exterior of the housing 12 and overlying the slits 80 to capture the fine particulate materials and dust that exit through the slits 80. The hoods 86 can take any of a variety of configurations that are suitable to capture and divert the fine particulate materials or dust to a collection chamber. For example, FIG. 11 depicts a hood 86A that extends along the vertical length of the housing 12 to overly five sets of slits 80 and a plurality of hoods 86B that each overly only a single set of slits 80. And FIG. 12 depicts a hood 86C that wraps around the circumference and bottom of the housing 12 to overly slits 80 disposed along a lower portion of the annular wall 18 and in the bottom end-wall 20.

The dust collection hoods 86 couple to transport tubes 88 through which the collected particulate material or dust can be passed to a collection chamber (not shown) or the collection chamber can be directly attached to or integrated with the hoods 86. A vacuum can be provided via the tubes 88 to draw the particulate material and dust into the hoods 86 and/or through the transport tubes 88. Or the airflow generated by operation of the mill 10 and flowing through the slits 80 can be relied upon to flow the particulate materials and dust to the collection chamber.

In an embodiment, a positive pressure or puff of air can be forced through the transport tubes 88 to force air into the housing 12. The puff of air may be employed to unclog one or more of the slits 80 or to stir up the particulate materials or dust to increase flow thereof through into the hoods 86 and/or transport tubes 88. For example, particulate material may collect at the bottom of the housing 12 on the bottom end-wall 20 rather than flowing out of the housing 12 through the slits 80. Air may be puffed or blown through the slits 80 in the bottom end-wall 20 to stir up or propel the particulate material back into the airflow in the housing 12 to thereby increase movement thereof toward the slits 80.

Figure 14:
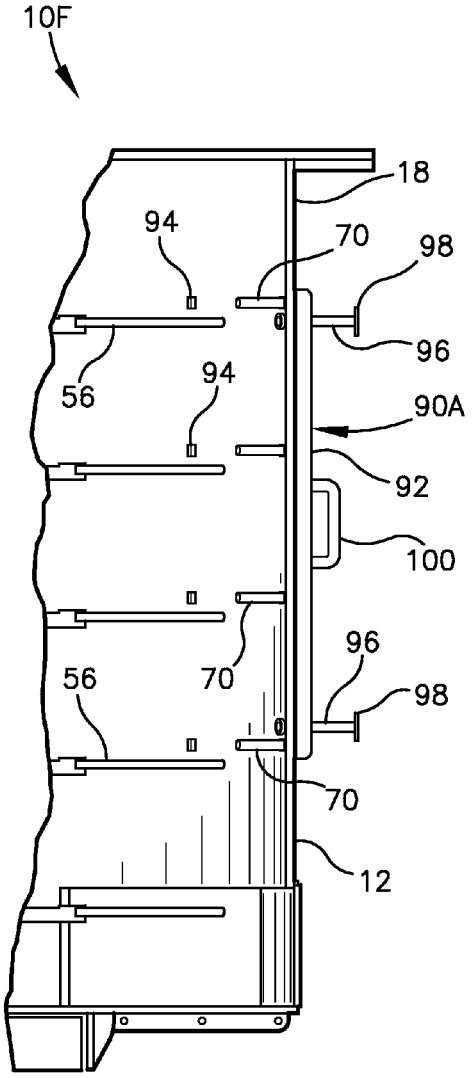
FIG. 14 is a partial cross-sectional elevational view of a comminution mill showing manually actuatable studs in an operational position depicted in accordance with an embodiment of the invention.
Figure 15:
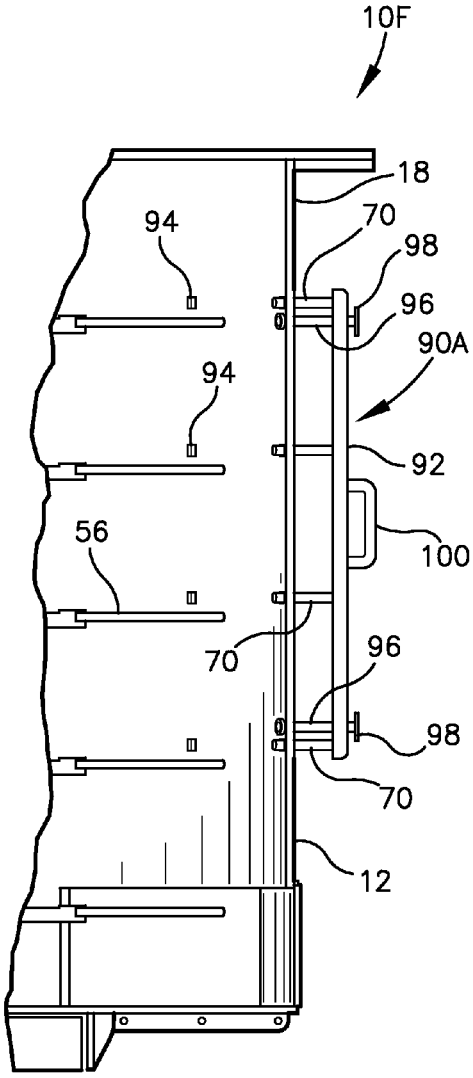
FIG. 15 is a partial cross-sectional elevational view of the comminution mill of FIG. 13 depicting the studs in a withdrawn position.
Figure 16:
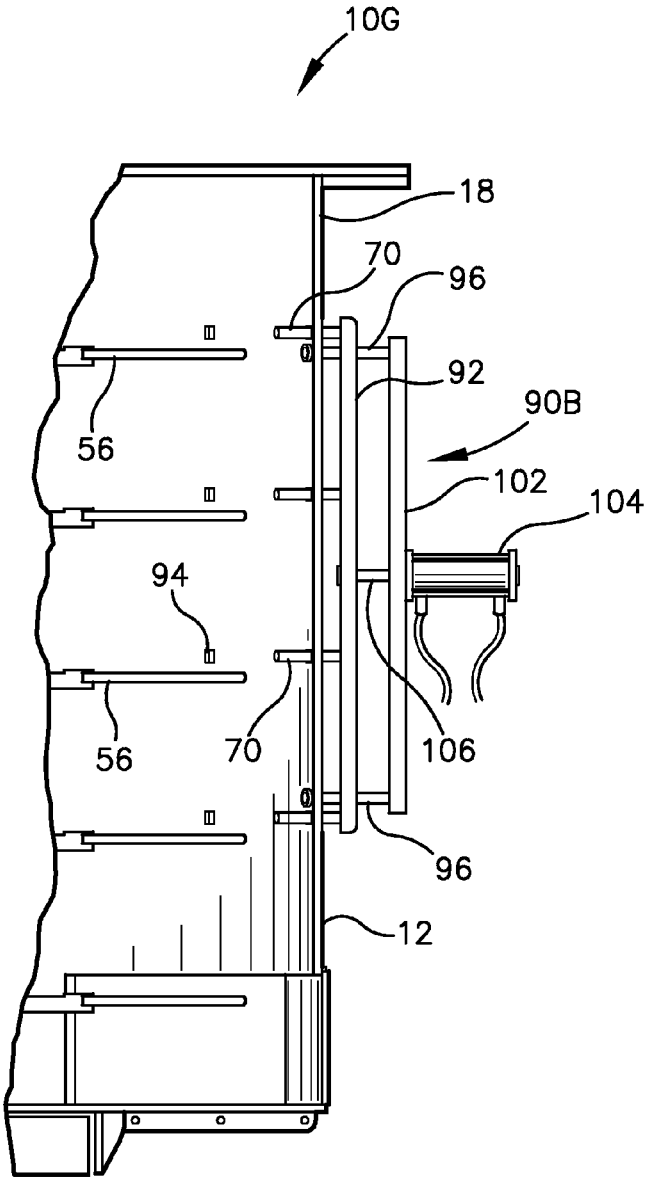
FIG. 16 is a partial cross-sectional elevational view of a comminution mill with hydraulically actuatable studs depicted in accordance with an embodiment of the invention.

With additional reference to FIGS. 14-16, a stud-actuation assembly 90 is depicted for enabling the studs 70 to be actuated between an operational position (FIG. 14) and a withdrawn position (FIG. 15). The stud-actuation assembly 90 can be configured for manual operation, the stud-actuation assembly 90A shown in FIGS. 14-15, or for automated operation as depicted by the stud-actuation assembly 90B in FIG. 16.

The stud-actuation assembly 90A includes a slide plate or body 92 that extends vertically between a plurality of vertically aligned studs 70. The body 92 might also be configured to extend circumferentially around the housing 12 to engage one or more studs that are spaced circumferentially about the housing 12. A first end of each of the studs 70 is coupled to the body 92 and an opposite second end of each of the studs 70 slideably extends through orifices 94 in the annular wall 18 toward the interior of the housing 12. The orifices 94 and studs 70 can be configured with relatively tight tolerances therebetween so as to restrict materials and/or airflow from passing through the orifice 94 between the stud 70 and annular wall 18.

A pair of guide pins 96 extend through respective apertures in the body 92 and are fixedly coupled to the annular wall 18. The guide pins 96 include a stop 98 or shoulder at a distal end thereof that is greater in dimensions than the apertures in the body 92 through which the guide pins 96 are installed. As such, the body 92 can slideably travel along the guide pins 96 toward and away from the annular wall 18 thereby inserting or withdrawing the studs 70 from the interior of the housing 12. The length of the guide pins 96 is configured to provide sufficient travel of the body 92 to withdraw the free ends of the studs 70 to a position that is substantially flush with an inner surface of the annular wall 18. In another embodiment, the length of the guide pins 96 can be configured to enable complete or only partial withdrawal of the studs 70 from the interior of the housing 12.

As shown in FIGS. 14 and 15 a handle 100 is disposed on the body 92 for enabling manual actuation of the stud-actuation assembly 90A. The stud-actuation assembly 90A can thus be actuated by simply pulling the handle 100 to move the body 92 and studs 70 along the guide pins 96 to insert or withdraw the studs 70 from the housing 12.

In another embodiment, the stud-actuation assembly 90B is configured for automatic or hydraulic actuation, as depicted in FIG. 16. The stud-actuation assembly 90B is configured similarly to the manual assembly 90A. However, in lieu of the stops 98, a support bar 102 is fixedly coupled between the distal ends of the guide pins 96. An actuator 104, such as a hydraulic actuator, is coupled to the support bar 102 with a piston rod 106 thereof extending to and coupling with the body 92. As such, actuation of the piston rod 106 by the actuator 104 extends the piston rod 106 to move the body 92 along the guide pins 96 and the studs 70 into the housing 12 or vice-versa. Although particular configurations of the stud-actuation assembly 90 are described herein, these configurations are intended to be exemplary and not limiting. It is to be understood that one of skill in the art will recognize additional configurations and methods for performing the functions thereof as described herein. All such additional configurations are within the scope of embodiments of the invention described herein.

With continued reference to FIGS. 1-5 and 8-16, operation of the mill 10 is described in accordance with an embodiment of the invention. Initially, the motor 16 is activated to begin rotation of the shaft 34 and thus the cables 56 or impact arms 66 within the housing 12. The shaft 34 is preferably rotated at a rotational speed of greater than about 1,500 RPM, or greater than about 1,700 RPM, or more preferably about 1,780 RPM, however slower speeds might also be employed. Rotation of the shaft 34 and the impact arms 66 generates airflow through the mill 10; no fans or impellers are required to generate the airflow. The airflow enters the intake chute 24, spirals around the interior of the housing 12, and exits the outlet chute at a velocity of greater than about 10-20 miles per hour or more preferably approximately about 25 miles per hour or greater.

Materials to be ground, such as plastic, paper, paperboard, cardboard, carpet, or similar dry waste materials are deposited into the mill 10 via the intake chute 24. Other materials such as wet materials, raw and/or virgin materials might also be deposited. The materials may be prepared prior to depositing into the mill 10 to aid comminution or separation of the materials by the mill 10. For example, carpet sections might be cut to twelve- or eighteen-inch square sections.

As the materials enter the housing 12 they are directed in a circular, spiraling, or cyclonic path around the interior of the mill 10 by the airflow, contact with the impact arms 66, and by the baffles 72 when provided. The endplates 74 on the baffles 72 may also act to slow the flow of the materials to increase the residence time in the mill 10.

The impact arms 66 repeatedly contact pieces of the material to perform the comminution thereof, e.g. grind, separate, tear, pulverize or otherwise break the pieces down into smaller and smaller particulates as the material passes through the mill 10. The comminution is aided by the studs 70. As the material flows around the interior of the housing 12, pieces thereof become entangled, obstructed, or otherwise slowed by the studs 70. As such, the material is struck by the impact arms 66 with a greater amount of force and a greater number of times before exiting the mill 10. And due to the close vertical proximity between the studs 70 and the impact arms 66, material that is entangled on or obstructed by the studs 72 can be struck and torn between the impact arms 66 and the studs 72. For example, during comminution of carpet, long fibers included in the backing of the carpet become entangled on the studs 70 while smaller carpet fibers and glue particles are liberated therefrom.

In some embodiments, the impact arms 66 of the upper most mounting plates 36A and B are comprised of larger diameter cables 56 while the lower mounting plates 36C-E utilize smaller diameter cables 56. As such, larger pieces of material entering the mill 10 at the top are initially broken down by the larger diameter cables 56 whose weight and size is more suitable for the larger pieces of material. The material is thus reduced to generally smaller sized pieces that can be subsequently further broken down by progressively smaller diameter cables 56. Thus, large diameter cables 56 are used to break down large pieces of material while smaller diameter cables 56 are used to break down smaller material particulates.

Upon reaching the bottom end of the housing 12, the ground, reduced size material particulate is expelled from the mill 10 through the outlet chute 30 by the airflow and/or by the centrifugal force associated with the material as it moves around the interior of the housing 12. The material can be passed to downstream material handling equipment such as conveyors or to one or more containers for further processing, shipment, storage, or use. The particulate material might also be expelled using gravity in embodiments having the outlet chute 33 disposed in the bottom end-plate 22 as in the mill 10A depicted in FIG. 6.

Additionally, flow rates of various portions of the ground or separated materials through the mill 10 may vary based on, for example the size or weight of the particles. Thus, heavier materials might exit the mill 10 first while lighter materials have a longer residence time in the mill 10. As such, the selectively positionable extension chutes 78, 78', and/or 78" depicted in FIGS. 13A-C might be configured for discharge between two or more collection basins as the separated and/or segregated materials exit the mill 10. Thereby, the materials can be separately collected.

The size and weight of the materials may also affect the amount of time the materials are within an area in the mill 10 in which the impact arms 66 may contact the materials, e.g. a comminuting field, due to, for example, the rate at which the materials fall through the housing 12. This residence time in the comminuting field may be increased by tilting the mill 10 at an angle or by orienting the mill 10 horizontally, e.g. with the rotational axis of the shaft 34 positioned at an angle of up to 90 degrees from vertical.

The ground or separated materials exiting the outlet chute 30 may have different flow rates or settling times, e.g. light materials may travel a short distance and/or may be thrust upwardly while heavier materials might travel longer distances and remain near or on a bottom surface of an outlet collection chute. These properties can also be employed to further separate the discharged materials.

In one exemplary embodiment, plastic soda or pop bottles are disposed in the mill 10 for comminution and separation into their component parts. Initially, the bottles include a bottle body, a label, a cap, a cap-retention ring around the neck of the bottle, and a gasket that is inside the cap. When placed in the mill 10, the labels, caps, and cap-retention rings are striped from the bottle bodies and the gaskets are also dislodged from the caps via the numerous impacts with the cables 56.

The varied physical characteristics of each of the components has been found to affect their flow through and out of the mill 10. The caps tend to fall through the mill 10 quickly and to be discharged a relatively long distance from the outlet chute 30. The labels tend to eject only a very short distance from the outlet chute 30 and the bottle bodies have a greater residence time due to their larger size and a short discharge distance. The gaskets have also been found to collect near the bottom of the mill 10. As such, the components of the plastic bottles can be substantially separated which increases the value of the ground product.

In an embodiment, a series of mills 10 can also be employed, each of which can be specifically configured to perform a particular function in the comminution/separating process. The mills 10 can directly feed material from one to another or their products can be separated and separately fed to subsequent mills 10 as desired. For example, plastic bottles might be initially fed to a mill 10 having only small diameter cables 56 to substantially remove labels from the bottle bodies. The cleaned bottle bodies might then be fed to a mill 10 having only larger diameter cables 56 configured to break down the bottle bodies into small pieces.

It has also been found that the airflow generated in the mill 10 aids to reduce and/or maintain a relatively low relative humidity within the mill 10. Such a feature aids in drying ground products, such as used plastic bottles that may contain small amounts of liquids therein. This may also eliminate needs for drying operations and apparatus that might be utilized following comminution operations.

In another exemplary application of the invention, sections of carpet cut into twelve- or eighteen-inch square sections are fed into the mill 10. The action of the cables 56 on the sections of carpet has been found to substantially liberate glue particulate, e.g. calcium carbonate, from the fibers of the carpet and backing materials. The glue particulate is captured in the airflow in the mill 10 as dust and flows through the slits 80 in the annular sidewall 18 and bottom end-wall 20 where it is collected via the hoods 86 overlying the slits 80.

The longer fibers of the carpet backing tend to collect on the studs 70 while the shorter carpet fibers pass through and are discharged from the mill 10. Periodically, following discharge of the short carpet fibers and preceding disposal of additional carpet sections into the mill 10, the studs 70 are withdrawn from the interior of the mill 10. Thus, the longer fibers of the carpet backing are dislodged from the studs 70 and allowed to be discharged from the mill 10. The studs 70 can then be re-inserted to continue comminution of additional carpet sections. Accordingly, the short carpet fibers, longer backing fibers, and glue particulate can be substantially liberated from one another and separated into individual containers. These separated and relatively pure materials are known to have a substantially greater value than in their un-separated and contaminated form.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A comminution mill comprising:

a cylindrical housing having a rotatable shaft disposed coaxially therein;

a plurality of cables removeably coupled to the shaft along the length thereof in one or more spaced apart, radially extending planes, each of the cables extending radially outward from the shaft toward but not contacting a sidewall of the housing, the cables being moved through the radial planes by rotation of the shaft and contacting materials deposited in the housing for comminution, and the movement of the cables generating an airflow through the housing; and a plurality of slits disposed in the sidewall of the housing through which particulate materials exit the housing.

2. The comminution mill of claim 1, further comprising:

a collection hood coupled to an exterior of the housing and enclosing one or more of the plurality of slits.

3. The comminution mill of claim 2, wherein the collection hood encloses slits that lie within one of the radial planes.

4. The comminution mill of claim 2, wherein the collection hood encloses slits that are generally vertically aligned and lie within more than one of the radial planes.

5. The comminution mill of claim 2, wherein the collection hood extends about the circumference of the housing.

6. The comminution mill of claim 1, further comprising:

a plurality of obstructing members extending radially inward from a sidewall of the housing and positioned vertically offset from the radial planes.

7. The comminution mill of claim 6, wherein one or more of the obstructing members are moveable inwardly and outwardly through the sidewall.

8. The comminution mill of claim 7, further comprising:

an actuating assembly that includes a body that is coupled to a first end of one or more of the obstructing members in the plurality, the actuating assembly being moveable between an operational position in which the one or more obstructing members extend through the sidewall and into an interior of the comminution mill and a withdrawn position in which the one or more obstructing members are at least partially withdrawn from the interior.

9. The comminution mill of claim 8, further comprising:

a guide pin along which the body slides to move between the operational and withdrawn positions.

10. The comminution mill of claim 8, further comprising a handle coupled to the body and useable to manually move the actuating assembly between the operational and withdrawn positions.

11. The comminution mill of claim 8, wherein the actuating assembly is one or more of hydraulically, pneumatically, or mechanically actuated.

12. The comminution mill of claim 1, wherein one or more of the plurality of cables includes an abrasive ring disposed on the cable.

13. A vertically oriented comminution mill comprising:

a cylindrical housing having a rotatable shaft disposed coaxially therein;

a plurality of mounting plates fixedly coupled to the shaft and spaced apart along the length thereof;

a plurality of cables coupled to each of the mounting plates and extending radially outward toward but not contacting a sidewall of the housing, the cables being moved through a radial plane by rotation of the shaft and contacting materials deposited in the housing for comminution, and the movement of the cables generating an airflow from the inlet through the housing to an outlet;

a plurality of slits disposed in the sidewall of the housing through which particulate materials exit the housing; and a collection hood coupled to an exterior of the housing and configured to receive the particulate materials exiting the housing through one or more of the slits.

14. The comminution mill of claim 13, wherein the slits in the plurality are arranged in groups of slits, and wherein a plurality of collection hoods is coupled to the exterior of the housing, each of the collection hoods being associated with a respective one or more groups of slits.

15. The comminution mill of claim 13, wherein the collection hood includes a discharge tube into which the particulate materials are channeled toward a collection basin, and wherein a fan is associated with the collection hood to move the particulate materials through the discharge tube.

16. The comminution mill of claim 13, wherein one or more of the cables includes an abrasive ring disposed thereon, the abrasive ring free-floating on the cable to enable rotation of the abrasive ring about the cable and movement of the abrasive ring along the length of the cable.

17. A vertically oriented comminution mill comprising:

a cylindrical housing having a rotatable shaft disposed coaxially therein;

a plurality of mounting plates fixedly coupled to the shaft and spaced apart along the length thereof;

a plurality of cables coupled to each of the mounting plates and extending radially outward toward but not contacting a sidewall of the housing, the cables being moved through a radial plane by rotation of the shaft and contacting materials deposited in the housing for comminution, and the movement of the cables generating an airflow from the inlet through the housing to an outlet; and a plurality of obstructing members extending radially inward from the sidewall of the housing and positioned vertically offset from the radial planes, the obstructing members being moveable through the sidewall between an operational position in which the obstructing members extend a first distance into the interior of the housing and a withdrawn position in which the obstructing members extend a second distance into the interior of the housing, the first distance being greater than the second distance.

18. The comminution mill of claim 17, further comprising:

an actuating assembly that includes a body that is coupled to first ends of one or more of the obstructing members, the actuating assembly being operable to move the obstructing members between the operational position and the withdrawn position.

19. The comminution mill of claim 17, wherein the actuating assembly is one or more of hydraulically, pneumatically, and mechanically actuated.

20. The comminution mill of claim 17, wherein materials being ground in the comminution mill collect on the obstructing members during comminution, and wherein movement of the obstructing members to the withdrawn position displaces the materials from the obstructing members for further comminution and passage through the housing.

* * * * *